United States Patent [19]

Goralnik

[11] Patent Number: 4,538,092

[45] Date of Patent: Aug. 27, 1985

[54] DIMMER AND STARTING CIRCUITS FOR A FLUORESCENT LAMP

[76] Inventor: Charles D. Goralnik, 200 Bryn Wyck Pl., St. Louis, Mo. 63141

[21] Appl. No.: 507,741

[22] Filed: Jun. 27, 1983

[51] Int. Cl.[3] ..... H01J 7/44

[52] U.S. Cl. ..... 315/58; 315/DIG. 4; 315/46

[58] Field of Search ..... 315/46, 47, DIG. 4, 315/54, 58, 284, 73

[56] References Cited

U.S. PATENT DOCUMENTS

| | | | |
|---|---|---|---|
| 2,911,569 | 11/1959 | Hutchins | 315/100 |
| 3,011,095 | 11/1961 | Kriechbaum | 315/284 X |
| 3,996,493 | 12/1976 | Davenport et al. | 315/58 |
| 4,135,114 | 1/1979 | Narikiyo | 315/73 X |

*Primary Examiner*—David K. Moore

*Attorney, Agent, or Firm*—Senniger, Powers, Leavitt and Roedel

[57] ABSTRACT

A dimmer for a fluorescent lamp comprising a ballast inductor and an impedance adjuster for connecting impedances of various values between a power source and one of the lamp filaments, the other lamp filament being connected through a starting switch to the one lamp filament and to the power source. The value of each impedance connected is such that it will allow a current sufficient to start the lamp to pass therethrough. A circuit is provided for increasing the impedance between the inductor and the lamp, upon starting of the lamp, to reduce the current from a level sufficient to start the lamp to a level below the minimum required to start the lamp but above the minimum required to maintain the lamp emission once started, whereby a reduced light intensity level is produced. In another embodiment the ballast inductor has an impedance such as would draw, during starting, a current greater than the maximum rated current capacity of the lamp filaments. A resistance impedance element having a resistance which would during starting, reduce the current through the filaments to a current not greater than the maximum rated current capacity thereof is connected in series with the starting switch between the two lamp filaments whereby during operation after starting the light intensity level of the fluorescent lamp is greater than would be produced at a current not exceeding the maximum rated filament current.

16 Claims, 4 Drawing Figures

DIMMER AND STARTING CIRCUITS FOR A FLUORESCENT LAMP

BACKGROUND OF THE INVENTION

This invention relates to dimmer and starting circuits for a fluorescent lamp.

Fluorescent lamps characteristically have a minimum current value which must be provided for reliable starting, which value varies with the lamp size. However, the current required for starting a lamp is far in excess of that needed to maintain an arc, once the arc has been struck, i.e., once the lamp is operating. The minimum current required to start a 22 watt circline lamp, for example, is approximately 275 milliamps. But the lamp will operate reliably on currents as low as 125–150 milliamps once the lamp has been started, i.e., once the arc has struck between the opposing lamp filaments. However, with the minimum starting current as the lower limit of current through the loop, the degree of dimming of the lamp is correspondingly limited. Fluorescent lamps also have a maximum current which is determined by the maximum current capacity of the lamp filaments. For example, a 22 watt circline tube can accommodate a maximum current of 875 milliamps. However, the actual maximum current through the lamp during operation, i.e., during light output, is much lower (approximately 600 milliamps) because the current during the pre-heating phase (before arc ignition) is substantially higher than after the arc has struck. The reason is that the impedance of the tube itself, which is in the circuit during operation but not during pre-heating, is on the order of 200 ohms, whereas the resistance of the filaments is much smaller, about 10 ohms. Thus, the impedance of the conventional lamp circuit during operation is much higher than during starting, which results in a lamp brightness during operation lower than what would be produced at the maximum current the filaments can carry. Single level fluorescent lamps as well as multiple-level lamps presently suffer from this same disadvantage. In the case of a single level lamp, the inability to get the desired brightness out of a particular lamp because of the filament current limitation is sometimes addressed by using a longer lamp to obtain the desired brightness. However, there are many fixture applications in which the size of the lamp presents significant design problems. A related disadvantage occurs in conventional fluorescent lamp circuits because the amount of silicon steel in the core of the choke ballast must be sufficient to avoid saturation at the highest electrical loading of the ballast, which occurs during the starting cycle of the lamp. At this time, the bulb or tube itself, as opposed to the lamp filaments, is shunted out of the circuit by the glow bottle starter circuit and thus the higher bulb impedance is not part of the circuit. Since the choke ballast must be designed to be electrically stable during this phase, it must have approximately 30% more magnetic permeability than it requires during operation (when the bulb is part of the circuit impedance).

SUMMARY OF THE INVENTION

Among the several objects of the invention may be noted the provision of a dimmer which enables operation of a fluorescent lamp with a lower light output than that obtainable from conventional fluorescent lamp dimmer circuits; the provision of a dimmer which enables operation of a fluorescent lamp with a higher light output than that obtainable from conventional fluorescent lamp circuits; the provision of a starting circuit for a fluorescent lamp which allows more brightness to be obtained from the lamp during operation; the provision of such a starting circuit which permits the use of smaller lamps to achieve the same brightness as obtainable from larger, conventional lamps; the provision of such a starting circuit which is lighter, smaller and less expensive than conventional starting circuits; and the provision of such a starting circuit which requires less steel for the core of the choke ballast than conventional starting circuits.

Briefly, a fluorescent lamp dimmer of the present invention is adapted to be connected between one terminal of a power source and a first filament of the fluorescent lamp, the other terminal of said power source being connected to the second filament of the lamp, and a starting switch interconnects the first and second filaments for opening the circuit therebetween when the filaments are sufficiently heated. The dimmer comprises ballast inductor means for providing impedances of various values for connection between the one power source terminal and the first filament. Impedance adjusting means are provided for effecting connection of one value of impedance to the first filament of the fluorescent lamp in a first position thereof and for effecting connection of a second value of impedance to the first filament of the fluorescent lamp in a second position thereof, each of these values of impedance being such as will allow a current sufficient to start the fluorescent lamp to pass therethrough. Means are also provided for increasing the impedance provided by the ballast inductor means, once starting of the fluorescent lamp has occurred, thereby to reduce the current from a level sufficient to start the fluorescent lamp to a level below the minimum current required to start the fluorescent lamp but above the minimum required to maintain the lamp emission once started, the last said means being adapted to be connected in series with the ballast inductor means between the first filament and one power source terminal, whereby the light intensity level of the fluorescent lamp during operation is reduced below that which would be produced by the minimum starting current of the lamp.

In a second embodiment a fluorescent lamp dimmer of the present invention includes ballast inductor means for providing impedances of various values for connection between one power source terminal and the first filament of the lamp. Impedance adjusting means are provided for effecting connection of first and second values of impedance to the first filament of the fluorescent lamp in first and second positions thereof, the first value of impedance being such as would draw a current through the filaments in excess of the maximum rated current capacity of the filaments and the second value of impedance being such that the current drawn through the filaments will not exceed the maximum rated filament current. A resistive impedance element is also provided for connection in series with a starting switch between the first and second filaments, this impedance element having a resistance such that when the impedance adjusting means is in its first position the current through said filaments will be reduced to a level not greater than the maximum rated current capacity of the filaments, whereby upon opening of the starting switch the light intensity level of the fluorescent lamp during operation is greater than would be produced at a current corresponding to the maximum rated filament current. Also provided are means for shunting the impedance element when the impedance adjusting means is in its second position whereby the light intensity level of the fuorescent lamp during operation is reduced from the aforesaid level.

A fluorescent lamp starting circuit of this invention includes ballast inductor means for connection between one terminal of a power source and a first filament of the fluorescent lamp, the lamp having a second filament for connection to the other power source terminal. A starting switch is provided for interconnecting the first and second filaments and will open when the filaments are sufficiently heated. The inductor means provides at least one impedance value which would during starting draw a current through the filaments in excess of the maximum rated current capacity thereof. Also provided is a resistive impedance element for connection in series with the starting switch between the first and second filaments of the fluorescent lamp during starting, which impedance element has a resistance sufficient to reduce the current through the filaments during starting at least to the maximum rated current capacity of the filaments, the opening of the starting switch upon starting of the lamp breaking the series circuit of the first filament, the impedance element, the starting switch and the second filament, thereby removing the impedance element from said circuit during operation of the fluorescent lamp, whereby the light intensity level of the fluorescent lamp during operation is greater than would be produced at a current not exceeding the maximum rated filament current.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
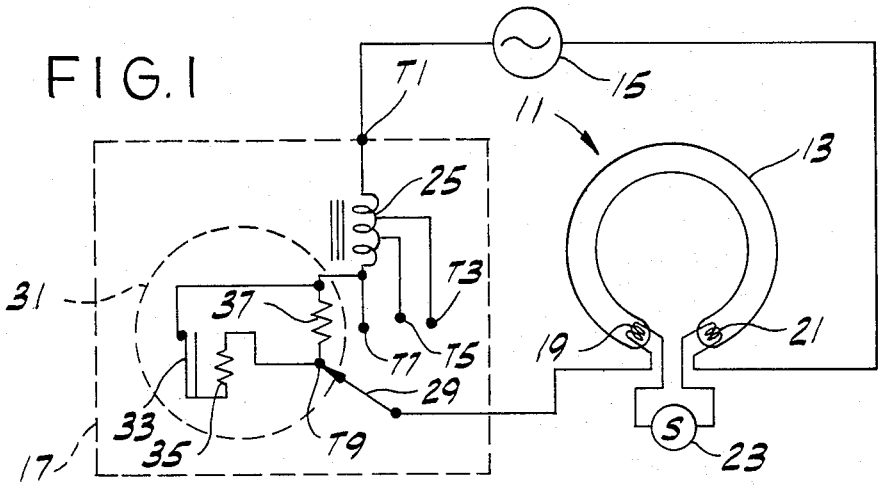
FIG. 1 is an electrical schematic of a first embodiment of a dimmer of this invention connected in series between a power source and a fluorescent lamp.

Referring now to the drawings, there is shown a fluorescent lamp 11 (FIG. 1) including a conventional gaseous discharge tube 13, such as a standard 22 watt fluorescent circline light tube of annular shape, a power source 15, such as conventional 115 V 60 Hz household or business wiring, and a dimmer 17 of the present invention. Lamp 11 includes first and second filaments 19 and 21 disposed at opposite ends of tube 13, and a starting switch 23, such as a glow bottle type, connected in series between filaments 19 and 21. The other side of filament 21, that side opposite the starting switch, is connected to one side of the power source. The other side of the power source is connected to a first end terminal T1 of a tapped ballast inductor 25 of dimmer 17. Inductor 25 has two intermediate taps or terminals T3 and T5 and a second end terminal T7 generally at the end of inductor 25 opposite terminal T1, for providing impedances of various values.

Dimmer 17 also includes a four-position switch 29 which constitutes means for adjusting the impedance value and selecting the brightness level desired during operation of tube 13. One side of switch 29 is connected to the side of filament 19 opposite starter switch 23 while the switch arm of the four-position switch may be manually moved to contact terminals T3, T5 and T7, the intermediate and second end terminals of inductor 25, to connect them to filament 19. The switch arm of switch 29 may also be manually moved to the position shown in FIG. 1 in which it connects a terminal T9 to filament 19. Terminal T9 is the output terminal of a parallel circuit 31 which constitutes means for increasing the impedance between terminal T1 and switch 29, when switch 29 is in the position shown in FIG. 1, once starting has occurred from a level corresponding to a current sufficient to start the lamp to a level corresponding to a current below the minimum required to start the lamp but above the minimum required to maintain lamp emission once started. More particularly, circuit 31 is connected to terminal T7 of ballast inductor 25 and includes the series combination of a bi-metal switch 33, which constitutes the temperature sensitive element of a time-delay thermally responsive switch, and a very low resistance heater resistor 35 in close heat exchange proximity thereto. In parallel with this series combination is a much larger resistance resistor 37 also in heat exchange relationship with the temperature sensitive device 33. Ballast inductor 25 has an impedance between terminal T1 and each of terminals T3, T5 and T7 which is sufficiently small to allow a current sufficient to start lamp 11 to pass therethrough during starting.

When it is desired to operate lamp 11 at its brightest level, the arm of switch 29 is placed in contact with terminal T3. Starting current flows through terminal T1, a portion of inductor 25, terminal T3, switch arm 29, filament 19, starter switch 23 and filament 21 until the arc is struck. At that time the higher impedance of tube 13 replaces starter circuit 23 in the circuit and the lamp operates at the brightness level corresponding to the series impedance of the portion of the inductor 25 between terminals T1 and T3 and the tube 13. Similarly, when it is desired to operate lamp 11 at its next brightest level, the arm of switch 29 is placed in contact with terminal T5. The impedance of the operating circuit is now increased and the brightness of the lamp reduced because the portion of inductor 25 between terminals T1 and T5 is now in the circuit. Likewise, when the arm of switch 29 contacts terminal T7 the brightness of lamp 11 is reduced even further. However, reduction of the brightness of the lamp below the minimum achieved by using entire inductor 25 requires the use of parallel circuit 31. The value of resistor 37 is chosen so that the current which will flow through inductor 25 and resistor 37 is insufficient to ignite the arc in lamp 11 but is sufficient, once the arc is struck (i.e., once lamp emission starts), to maintain the arc. The brightness achieved in this manner is low enough to permit use of lamp 11 as a night light in this particular example. To obtain this low level of brightness, the arm of switch 29 is moved to contact terminal T9. Starting current then flows through the entire length of inductor 25 between terminals T1 and T7, through bimetal switch 33 and through heater resistor 35 to terminal T9. The resistance of heater resistor 35 is chosen so that sufficient current flows through circuit 31 to reliably start lamp 11. It is preferred that the difference in resistances between resistors 35 and 37 be such that resistor 37 is effectively shunted out of the circuit during starting. As starting current flows through resistor 35 it begins to warm. Bimetal switch 33 is selected so that it does not open in response to the heat from resistor 35 until or after the arc has been struck. Once bimetal switch 33 opens, lamp 11 dims because the resulting addition of the impedance of resistor 37 to the circuit reduces the operating current. Resistor 37 is also positioned in heat exchange relationship to bimetal switch 33 so that the bimetal switch is maintained open by the heat produced by the operating current flowing through resistor 37. When the lamp is turned off, by moving the switch arm of switch 29 away from terminal T9, or if the lamp failed to start, the absence of current through either resistance 35 or 37 allows bimetal switch 33 to close, so that the lamp can be restarted.

It has been found that the inclusion of a dimmer of this invention such as dimmer switch 17 allows the dimming range of a 22 watt lamp, for example, to be increased from its normal 18–40 watts to approximately 7–40 watts. Thus, the dimming range is increased from a ratio of less than 2.5 to 1 to almost 6 to 1.

Figure 2:
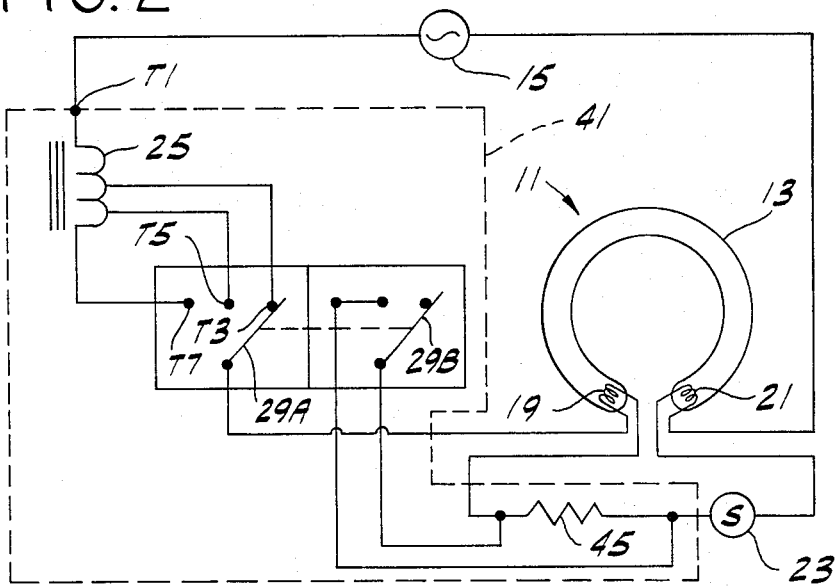
FIG. 2 is an electrical schematic of a second embodiment of a dimmer of this invention connected in series between a power source and a fluorescent lamp.

Referring now to FIG. 2, a second embodiment of the dimmer of this invention is indicated at 41 connected to power source 15, a starting switch 23 and a 22-watt (for example) circline type lamp 11 having first and second filaments 19 and 21 positioned at opposite ends of tube 13. Dimmer 41 includes tapped ballast inductor 25 having terminals T1 (connected to power source 15), T3, T5 and T7. Terminals T3, T5 and T7 are engageable by the switch arm of a three-position switch 29A and the common terminal of switch 29A is connected to one side of filament 19. The other side of filament 19 is not connected directly to starting switch 23 but rather is connected through a resistive impedance element 45 (whose impedance is substantially the same as the impedance of the fluorescent lamp 11 during operation, e.g., 200 ohms) to the starting switch. A three-position switch 29B, which is ganged to switch 29A, is provided to shunt resistive impedance element 45 out of the circuit when switch 29B is in the leftmost two of the three possible positions. With dimmer 41, it is possible to select the top position of terminal T3 along inductor 25 so that the impedance between terminals T1 and T3, when added to the impedance of filaments 19 and 21, corresponds to a current through the filaments greater than the maximum current capacity of the filaments. Of course, this current never actually flows through the filaments since when switches 29A and 29B are in the position shown in FIG. 2, resistive impedance element 45 is interposed in the circuit and the filament current is correspondingly reduced at least to the maximum current carrying capacity of the filaments. When the starting switch 23 opens upon starting, resistive impedance element 45 is removed from the circuit and bulb 13 is included in the circuit. By chosing the impedance of element 45 to substantially equal the impedance of lamp 11, one ensures that the operating current of the lamp is substantially the same as the starting current. This greater operating current than that achieved by conventional lamps results in a higher maximum brightness for a given lamp than that which would be produced at a current corresponding to the maximum rated filament current.

Element 45 does not affect the starting current of lamp 11 when lower brightness levels are selected because switch 29B constitutes means for shunting impedance element 45 out of the series filament circuit whenever three-position switch 29A is closed through one of terminals T5 or T7, which terminals correspond, even in the absence of element 45, to a current less than the maximum filament current.

Figure 3:
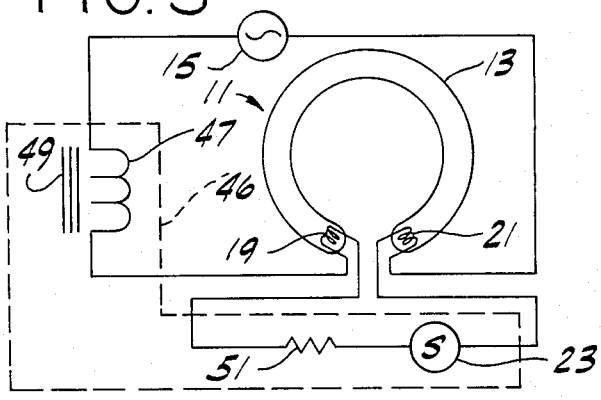
FIG. 3 is an electrical schematic of a starting circuit of the present invention shown connected to a power source and a fluorescent lamp.
Figure 4:
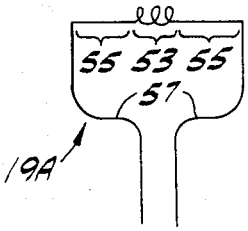
FIG. 4 is an elevation of a filament of a fluorescent lamp.

Referring now to FIG. 3, a starting circuit 46 very similar to dimmer 41 includes an untapped choke ballast inductor 47 having a silicon steel core 49, a resistive impedance element 51 and glow bottle type starting switch 23 connected to a fluorescent lamp 11 and power source 15 in generally the same manner as shown in FIG. 2. By selecting the impedance of inductor 47 to equal the impedance between terminals T1 and T3 of FIG. 2 and by selecting the impedance of element 51 to equal the impedance of element 45 of FIG. 2, the circuit of FIG. 3 provides a single-brightness level for lamp 11 which equals the maximum brightness obtainable from the circuit of FIG. 2. In this example the impedance of inductor 47 is chosen so that during operation, when element 51 is out of the circuit, the maximum current capacity of the filaments is not exceeded. Alternatively, one can use the circuit of FIG. 3 and select an even lower impedance for inductor 47 and a higher impedance for element 51 (i.e., one greater than the impedance of lamp 11 during operation) such that the maximum filament current capacity is not exceeded during starting but the current during operation exceeds the maximum filament current capacity. It has been found that an operating current which exceeds somewhat the maximum current carrying capacity of the filaments will not burn out the filaments for the following reasons: Filament 19, for example, can be divided into two general regions 53 and 55 (FIG. 4) which are supported by a combined support and electrical connection 57. Region 53 is a coiled portion of, for example, three loops of suitable resistive and emissive material while region 55 consists of relatively straight leg portions on either side of region 53. During the preheating phase of starting, the total current is impressed across the entire filament. The coiled region, being the most condensed, reaches a higher temperature and becomes thermionically emissive. When the glow bottle starting switch opens, the arc strikes between the coiled regions of both filaments. However, the arc almost immediately shifts from the coiled regions to that section of the leg portions closest to the source of electric potential with emissive material on its surface. Because the leg portions are straight, they are capable of withstanding a higher current than the coiled portions without failing, so an inductor 47 with lower impedance as mentioned may be used. Of course, the impedance of inductor 47 must still be high enough to prevent the leg portions from also failing due to the higher current. Choosing inductor 47 and element 51 in this manner provides an even higher level of brightness from a given lamp than that obtainable from the circuit of FIG. 2. Thus a very substantial increase in the lumen-length output ratio of a fluorescent lamp is simply and inexpensively achieved. For example, the light outputs of 24 inch (20 watt) and 18 inch (15 watt) fluorescent lamps by the use of the circuit of FIG. 3 can be increased to approximate those of much longer and higher wattage fluorescent tubes, e.g., 36 inch (30 watt) and 24 inch (20 watt) ones, respectively.

Alternatively, circuit 46 can be used to obtain the conventional amount of brightness out of lamp 11. The presence of additional resistive element 51 in the starting circuit reduces starting current, which is the maximum current choke inductor 47 must carry. Since core 49 is sized to be stable during starting, the maximum current condition, a reduction of starting current enables the use of a smaller core 49 than is conventionally used, with an attendant reduction in weight and size of the starting circuit 46. It has been found that the size of the steel core can be reduced by approximately 40% using circuit 46 with the impedance of element 51 being approximately the same as the impedance of the lamp during starting. The inductor is chosen to reach saturation at some margin less than 10% greater (e.g., 5%) than the operating current of the lamp, rather than the 60% margin usually required, because element 51 limits the starting current to generally the same value as the operating current.

It will be understood that although annular or circline fluorescent tubes have been described in the specific embodiments disclosed above, the dimmers and starting circuits of this invention may be used in conjunction with straight elongate fluorescent tubes or bulbs.

In view of the above, it will be seen that the several objects of the invention are achieved and other advantageous results attained.

As various changes could be made in the above constructions without departing from the scope of the invention, it is intended that all matter contained in the above description or shown in the accompanyings drawing shall be interpreted as illustrative and not in a limiting sense.

What is claimed is:

1. A dimmer for a fluorescent lamp adapted to be connected between one terminal of a power source and a first filament of the fluorescent lamp, the other terminal of said power source being connected to the second filament of the lamp, and a starting switch interconnecting said first and second filaments for opening the circuit therebetween when the filaments are sufficiently heated, said dimmer comprising:

ballast inductor means for providing impedances of various values, said ballast inductor means being adapted for connection between said one power source terminal and said first filament;

impedance adjusting means for effecting connection of one value of impedance to the first filament of the fluorescent lamp in a first position thereof and for effecting connection of a second value of impedance to said first filament of the fluorescent lamp in a second position thereof, each of said values of impedance being such as will allow a current sufficient to start the fluorescent lamp to pass therethrough; and means for increasing the impedance provided by the ballast inductor means, once starting of the fluorescent lamp has occurred, to reduce the current from a level sufficient to start the fluorescent lamp to a level below the minimum current required to start the fluorescent lamp but above the minimum required to maintain the lamp emission once started, the last said means being adapted to be connected in series with the ballast inductor means between said first filament and said one power source terminal, whereby the light intensity level of the fluorescent lamp during operation is reduced below that which would be produced at a current corresponding to the minimum starting current of the lamp.

2. A dimmer as set forth in claim 1 in which the ballast inductor has a plurality of taps, and in which said impedance adjusting means is a multiple-position switch for connecting different tapped sections of the ballast inductor between the power source and the first terminal.

3. A dimmer as set forth in claim 1 wherein the impedance increasing means comprises a resistive impedance element connected in series with said ballast inductor means between said one power source terminal and said first filament, and a temperature sensitive shunting device connected in parallel with said resistive impedance element adapted to open after starting of the lamp.

4. A dimmer as set forth in claim 3 wherein the impedance increasing means includes a heating element through which starting current for the fluorescent lamp flows, said heating element being in close proximity to the temperature sensitive device, the temperature sensitive device being responsive to the heating element reaching a temperature indicative of the starting of the fluorescent lamp to open to cause all current through the impedance increasing means to flow through the resistive impedance element.

5. A dimmer as set forth in claim 4 wherein the heating element is connected in series with the temperature sensitive device.

6. A dimmer as set forth in claim 4 wherein the resistive impedance element is positioned in heat exchange relationship with the temperature sensitive device, the heat generated by lamp operating current flowing through the resistive impedance element during operation and after starting being sufficient to keep the temperature sensitive device open.

7. A dimmer for a fluorescent lamp adapted to be connected between one terminal of a power source and a first filament of the fluorescent lamp, the other terminal of said power source being connected to the second filament of the lamp, and a starting switch interconnecting said first and second filaments for opening the circuit therebetween when the filaments are sufficiently heated, said dimmer comprising:

ballast inductor means for providing impedances of various values, said ballast inductor means being adapted for connection between said one power source terminal and said first filament;

impedance adjusting means for effecting connection of a first value of impedance to the first filament of the fluorescent lamp in a first position thereof and for effecting connection of a second value of impedance to said first filament of the fluorescent lamp in a second position thereof, said first value of impedance being such as would draw a current through the filaments in excess of the maximum rated current capacity of the filaments and the second value of impedance being such that the current drawn through the filaments will not exceed the maximum rated filament current;

a resistive impedance element for connection in series with the starting switch between the first and second filaments, said impedance element having a resistance such that when said impedance adjusting means is in its first position the current through said filaments will be reduced to a level not greater than the maximum rated current capacity of the filaments, whereby upon opening of the starting switch the light intensity level of the fluorescent lamp during operation is greater than would be produced at a current corresponding to the maximum rated filament current; and means for shunting the impedance element when said impedance adjusting means is in its second position whereby the light intensity level of the fluorescent lamp during operation is reduced from the aforesaid level.

8. A dimmer as set forth in claim 7 which the ballast inductor has a plurality of taps, and in which said impedance adjusting means is a multiple-position switch for connecting different tapped sections of the ballast inductor between the power source and the first terminal.

9. A dimmer as set forth in claim 7 wherein the impedance of the resistance impedance element is substantially the same as the impedance of the fluorescent lamp during operation.

10. A dimmer as set forth in claim 7 wherein the impedance adjusting means is a multiple-position switch and the shunting means is a switch ganged therewith.

11. A starting circuit for a fluorescent lamp comprising:

ballast inductor means for connection between one terminal of a power source and a first filament of the fluorescent lamp, the lamp having a second filament for connection to the other power source terminal;

a starting switch for interconnecting the first and second filaments and adapted to open when the filaments are sufficiently heated;

the inductor means providing at least one impedance value which would during starting draw a current through the filaments in excess of the maximum rated current capacity thereof; and a resistive impedance element for connection in series with the starting switch between the first and second filaments of the fluorescent lamp during starting, which impedance element has a resistance sufficient to reduce the current through the filaments during starting at least to the maximum rated current capacity of the filaments, the opening of the starting switch upon starting of the lamp breaking the series circuit of the first filament, the impedance element, the starting switch and the second filament, thereby removing the impedance element from said circuit during operation of the fluorescent lamp, whereby the light intensity level of the fluorescent lamp during operation is greater than would be produced at a current not exceeding the maximum rated filament current.

12. A starting circuit as set forth in claim 11 wherein the impedance of the impedance element is at least equal to the impedance of the fluorescent lamp during operation.

13. A starting circuit as set forth in claim 11 wherein the ballast inductor means includes a core which would saturate during starting of the fluorescent lamp in the absence of the impedance element.

14. A starting circuit as set forth in claim 11 wherein the ballast inductor means includes a core which reaches saturation at a current less than 10% greater than the operating current of the fluorescent lamp.

15. A starting circuit as set forth in claim 11 in which the ballast inductor means is adjustable and provides other impedance values and which in a first position thereof effects connection of an impedance value between said one power source terminal and the first filament which would during starting draw a current through the filament in excess of the maximum rated current capacity thereof thereby during operation after starting produce the greater light intensity level, and in a second position thereof effects connection of an impedance value between said one power source terminal and the first filament which would during starting draw a current through the filament not greater than the maximum rated current capacity thereof and during operation after starting produce a lesser light intensity level.

16. A starting circuit as set forth in claim 15 which further includes a shunting means cooperative with the adjustable ballast inductor means to shunt the impedance element when said inductor is in its second position; said impedance element, said adjustable ballast inductor means and said shunting means comprising a dimmer switch.

* * * * *